US007493951B1

(12) United States Patent
Kravits et al.

(10) Patent No.: US 7,493,951 B1
(45) Date of Patent: Feb. 24, 2009

(54) UNDER-BALANCED DIRECTIONAL DRILLING SYSTEM

(75) Inventors: Stephen J. Kravits, Pleasant Hills, PA (US); Bruce D. Rusby, Jefferson Hills, PA (US); John K. Wood, Harrison City, PA (US)

(73) Assignee: Target Drilling, Inc., Jefferson Hills, PA (US)

( * ) Notice: Subject to any disclaimer, the term of this patent is extended or adjusted under 35 U.S.C. 154(b) by 109 days.

(21) Appl. No.: 11/598,555

(22) Filed: Nov. 13, 2006

Related U.S. Application Data

(60) Provisional application No. 60/736,377, filed on Nov. 14, 2005.

(51) Int. Cl.
*E21B 43/30* (2006.01)

(52) U.S. Cl. ..... 166/245; 166/50; 166/369

(58) Field of Classification Search ..... 166/50, 166/245, 369

See application file for complete search history.

(56) References Cited

U.S. PATENT DOCUMENTS

| | | | | |
|---|---|---|---|---|
| 6,280,000 | B1 | 8/2001 | Zupanick | |
| 6,681,855 | B2 | 1/2004 | Zupanick et al. | |
| 6,976,533 | B2 | 12/2005 | Zupanick | |
| 2004/0108110 | A1 | 6/2004 | Zupanick | |
| 2005/0051326 | A1 | 3/2005 | Toothman, Jr. et al. | |
| 2006/0266517 | A1 * | 11/2006 | Stayton | 166/245 |

* cited by examiner

*Primary Examiner*—Giovanna C Wright
(74) *Attorney, Agent, or Firm*—The Webb Law Firm

(57) ABSTRACT

A production well arrangement that includes a vertical main well extending into a gas producing strata and an access hole having a vertical portion coupled to a curved portion, which is coupled to a lateral portion. The vertical portion has an upper end defined on the ground surface and is laterally offset from the vertical main well. The lateral portion has a lateral end intersecting the vertical main well at an intersection point positioned between an upper end and lower end of the vertical main well, wherein the lateral end of the lateral portion does not extend beyond the vertical main well. One or more laterally extending holes extends from an intercepted zone defined on the access hole, which is upstream of the intersection point, wherein the one or more laterally extending holes do not intersect the vertically extending well.

35 Claims, 7 Drawing Sheets

UNDER-BALANCED DIRECTIONAL DRILLING SYSTEM

CROSS REFERENCE TO RELATED APPLICATION

This application claims the benefit of U.S. Provisional Application No. 60/736,377 entitled "Under-Balanced Directional Drilling System," filed on Nov. 14, 2005, which is hereby incorporated by reference.

BACKGROUND OF THE INVENTION

1. Field of the Invention

The present invention relates generally to systems and methods for the recovery of subterranean deposits and, more particularly, to an arrangement and method for removal of fluid and the production of gas from a desired subterranean formation.

2. Description of Related Art

Subterranean formations often contain desirable fluids and gases that can be used for many applications. Subterranean formations can include but not limited to coal beds (also referred to as coal seams), carbonaceous shales, silicious shales, sandstone, chalk or any target formation containing hydrocarbons.

Coal is a large energy source. It has been mined from the earth for many years. Deposits of coal beneath the ground surface are positioned in generally horizontal coal seams and include substantial quantities of methane gas entrained in the coal deposits. In underground coal mining, methane gas poses a significant safety risk to the miners. In the past, the methane gas entrained in the coal deposits was simply liberated from the coal, mixed with air in the mine which diluted it to a safe concentration, and the mixture was ventilated to the outside environment. The methane was simply dissipated into the environment and provided no meaningful resource. However, in recent years, there has been a thrust to use the entrained methane gas as an efficient energy source and sell it commercially. Typically, the methane gas can be used as a driving source for energy-producing equipment, such as generators or the like, or can be added to natural gas pipelines.

Utilizing the gas as an energy source requires that the gas be extracted in a concentrated state and captured. Extracting methane from the coal seams in a concentrated state has been achieved by drilling boreholes, generally horizontally, into the coal seam that can extend several thousands of feet.

During and after the methane drilling process, dewatering must occur. Since coal seams may have a significant amount of subterranean water associated with them, water must be drained from the coal seam in order to produce the methane. Further, during the drilling process, water may be used at the drilling tip, creating a slurry of drill cuttings, which also must be removed from the borehole. Water and drill cuttings can block the migration of gas through the coal seam to the borehole and therefore must be removed to permit degasification. Additionally, some of the water used in the drilling process can be forced under pressure into the coal seam, further saturating the gas reservoir, which impedes the migration of gas to the borehole. Therefore, dewatering must occur both during the drilling process and after drilling has been completed.

Long, generally horizontal boreholes that remain in the coal seam are the most effective manner to extract and capture the gas entrained in the coal seam. A horizontal well, or horizontal portion of a main well bore may extend over a significant length of the coal seam and intersect multiple natural fractures within the coal seam which provide a passageway for fluid to migrate to the well bore. By "fluid" means all liquids and gases including but not limited to water, brine, chemically entrained liquids, foam, air, nitrogen or hydrocarbons injected into and/or removed from a well.

When drilling horizontal and/or vertical wells targeting low pressure reservoirs containing hydrocarbons, it is desirable to use under-balanced drilling. Under-balanced drilling is a method of drilling a desired subterranean formation, whereby the hydrostatic pressure exerted by a column of drilling fluid in the well bore and/or exiting the drill string tip is less than a natural formation pressure inherent in the targeted subterranean formation. Under-balanced techniques are utilized to prevent damage to the desired subterranean formation and, in particular, low pressure formations. The introduction of air, nitrogen or other gases to the drilling fluids reduces the density of the co-mingled fluids and effectively decreases hydrostatic pressure. Other low-density fluids such as chemical foams and air mists (compressed air and water) may be used as a drilling fluid to achieve an under-balanced condition. The under-balanced environment prevents damage to the formation and facilitates the removal of cuttings and drilling fluids through the curve and vertical sections of the main well bore to the surface, during drilling operations.

One prior art method used to remove desirable fluids is described in U.S. Pat. No. 6,280,000, issued to Zupanick. This method uses both a horizontal well and a vertical well that intersect each other. However, this method utilizes drilling of a large cavity in the vertical well. The enlarged cavity is more costly and requires a longer period of time to construct. The large diameter cavity can induce unstable conditions at the intersections of the horizontal and vertical well bore that causes the exposed coal and/or rocks to fall and accumulate within the cavity or well bore. This accumulation may impair removal of fluids from the cavity or well bore.

Another prior art method used to remove fluids is described in U.S. Patent Publication No. 2005/0051326 to Toothman, Jr. et al. This method also uses both a horizontal well and a vertical well that intersect each other, wherein compressed air typically injected into the vertical well creates an under-balanced condition during the drilling process. However, the compressed air can also flow into the horizontal laterals in the coal seam of the main well bore and into any other additional laterals that extend from the main horizontal lateral, thus further saturating the gas reservoir which may impede the migration of gas from the formation to the borehole.

The present invention overcomes the above deficiencies by only having one direction that the compressed air can flow, with minimal, if any, air flow into the horizontal laterals extending into the subterranean formation while maintaining an under-balanced condition.

SUMMARY OF THE INVENTION

The present invention is directed to a production well arrangement provided in gas producing strata such as a coal bed or coal seam. The production well arrangement includes a first vertically extending well extending into a gas producing strata, wherein the well having a substantially continuous diameter has an upper end defined on a ground surface and a lower end. The arrangement further includes a first access hole having a vertical portion coupled to a curved intermediate portion, which is coupled to a lateral portion. The vertical portion has an upper end defined on the ground surface and is laterally offset from the upper end of the first vertically extending well. The lateral portion has a lateral end intersecting the first vertically extending well at an intersection point positioned between the first vertically extending well upper end and the first vertically extending well lower end, wherein the lateral end of the lateral portion does not extend beyond the first vertically extending well. The first access hole is positioned upstream from the intersection point of the lateral end and the first vertically extending well. One or more laterally extending holes extends from an intercepted zone defined on the first access hole, which is upstream of the intersection point, wherein the one or more laterally extending holes do not intersect the vertically extending well.

The present invention is also directed to a method for forming an under-balanced gas producing well in a ground for removing fluids, such as water, waste material and drilling effluent, and producing gas from a gas bearing strata, such as a coal bed, both during and after drilling completion. The steps include forming a production well arrangement as previously discussed. Injecting compressed gas, such as air or air foam, into the vertically extending well and allowing the gas to flow into the lateral end of the lateral portion and out the access hole through the curved portion and vertical portion to the surface, thus helping to lift the drill effluent consisting of water or air foam and drill cuttings to the surface to prevent over-pressuring of the coal bed. Next, additional horizontal lateral holes can be drilled starting or initiated from an intercepted zone Z and extend a distance into the coal bed either to the left or right of the vertical extending well, without intersecting the vertically extending well. In addition to injecting compressed air or air foam down the vertically extending well during the drilling of the lateral holes targeting the subterranean formation, a dewatering pump can also be installed in the vertically extending well to assist removing drill effluent without interfering with the drilling of the laterals. After the drilling process is complete, the drilling equipment is then removed from the access hole and a pump is installed into the vertically extending well to dewater the lateral holes and recover gas through the access hole and/or vertically extending well while keeping the pressure in all of the lateral holes below the coal bed formation pressure or preferably at zero pressure at a bottom of the vertically extending well and the curved portion with higher gas formation pressure in the lateral holes, thus permitting gas production to the surface.

DETAILED DESCRIPTION OF THE INVENTION

Figure 1A:
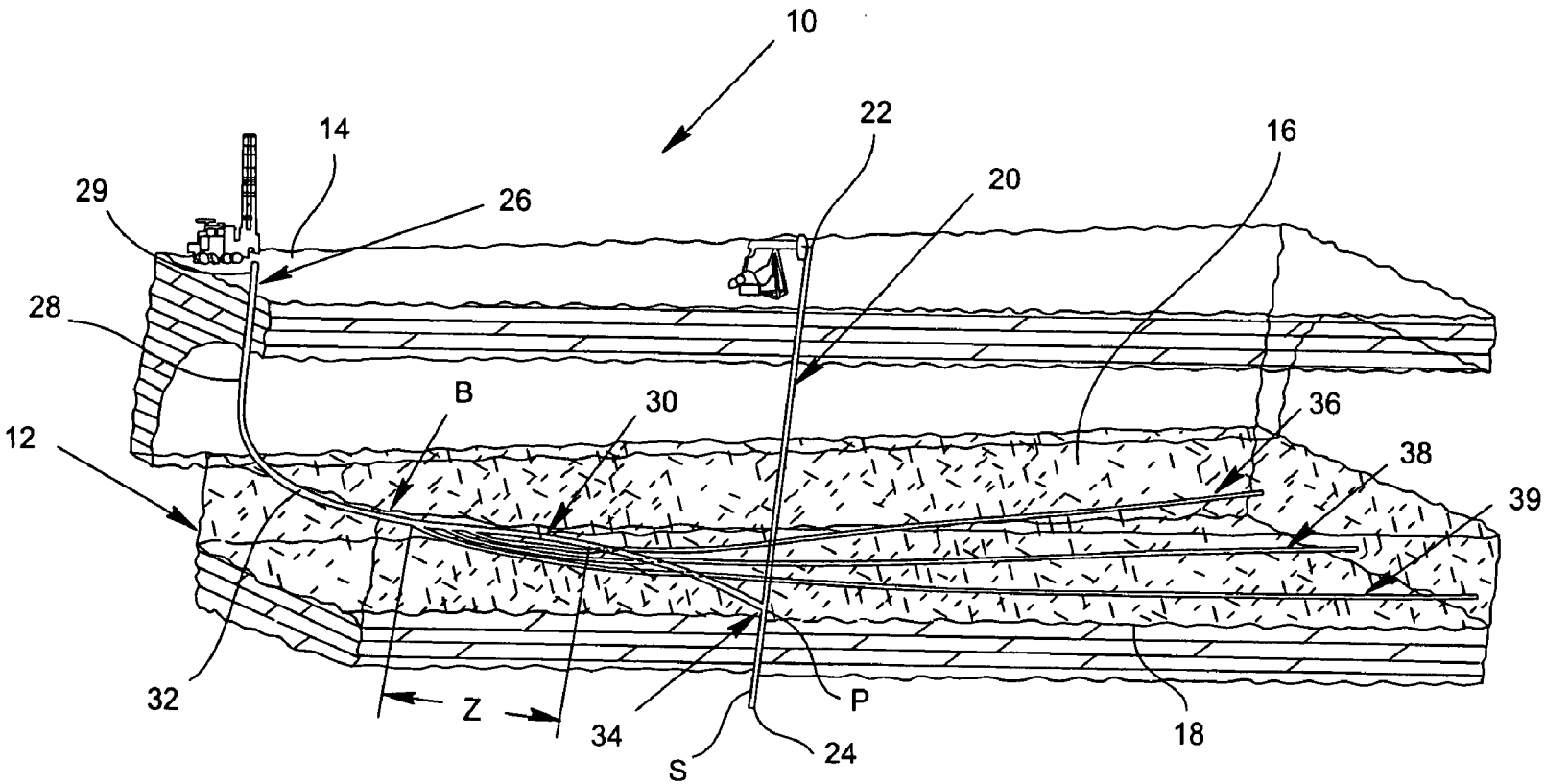
FIG. 1A is an illustration of a production well arrangement provided in a gas producing strata according to the present invention.
Figure 1B:
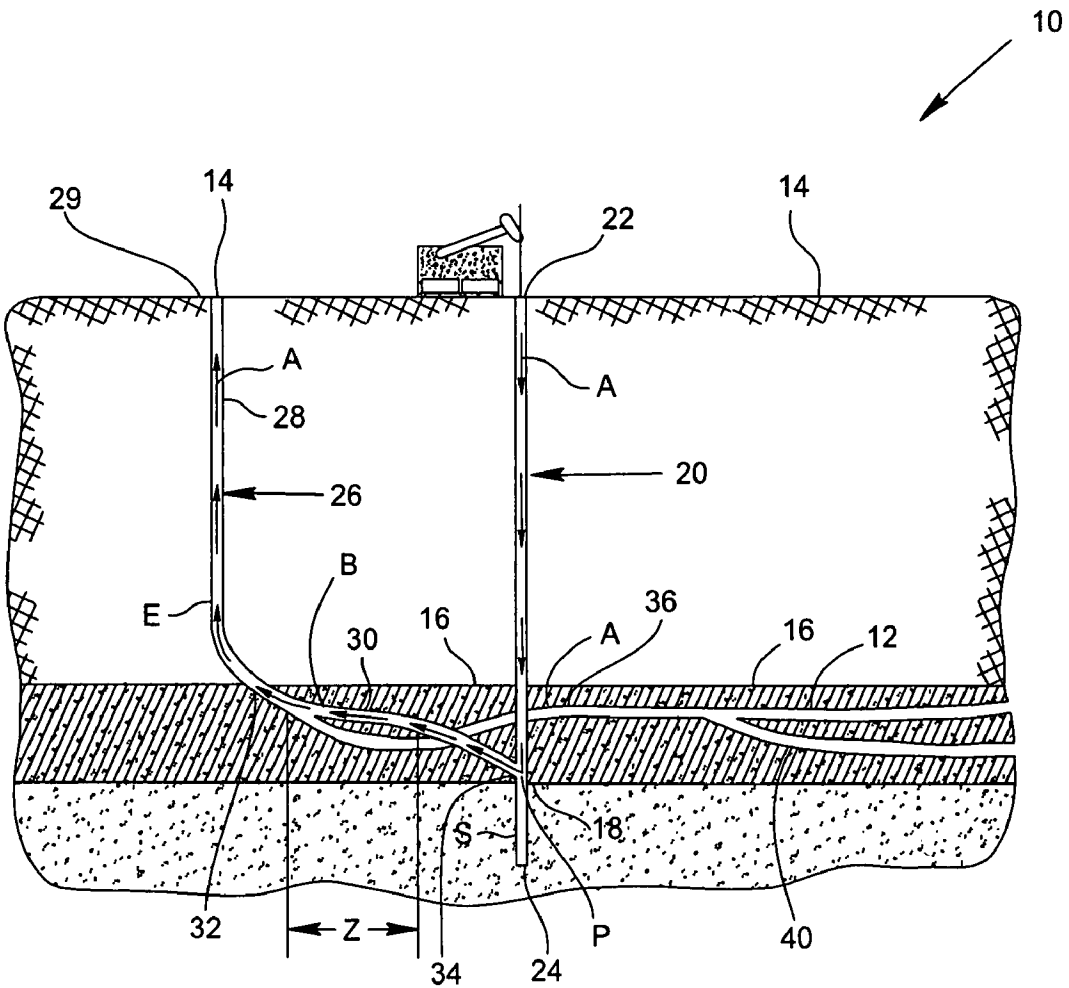
FIG. 1B is a cross-sectional schematic view showing a single lateral hole extending through a coal bed of the arrangement shown in FIG. 1A.

Referring to FIGS. 1A and 1B, the present invention is directed to a production well arrangement 10 for removing fluid and producing gas, typically methane, from a subterranean formation such as a gas bearing strata, a gas reservoir or other formations containing hydrocarbons. The subterranean formation may be any geological medium, preferably a coal bed 12, which is typically located below the earth's surface 14 and lies substantially horizontally and near parallel with the surface 14. For example, a coal bed may lie up to 3,000 feet below the surface 14 and generally has a minimum thickness of a few feet to maximum thickness of about 150 feet. The thickness of the coal bed 12 is defined by a distance between a top 16 and a bottom 18 of the coal bed 12. In order to extract methane gas from the coal bed 12, the present invention utilizes a directional drilling method which is well known in the art. The arrangement 10 incorporates a vertically extending main well 20 having a continuous diameter and having an upper end 22 and a lower end 24 that extends from a surface 14 to a point below the bottom 18 of the coal bed 12. The purpose of extending the vertical main well 20 below the coal bed 12 is to provide a sump S or chamber with adequate capacity for the collection of fluids, debris and coal fines to be removed to the surface 14.

Figure 2:
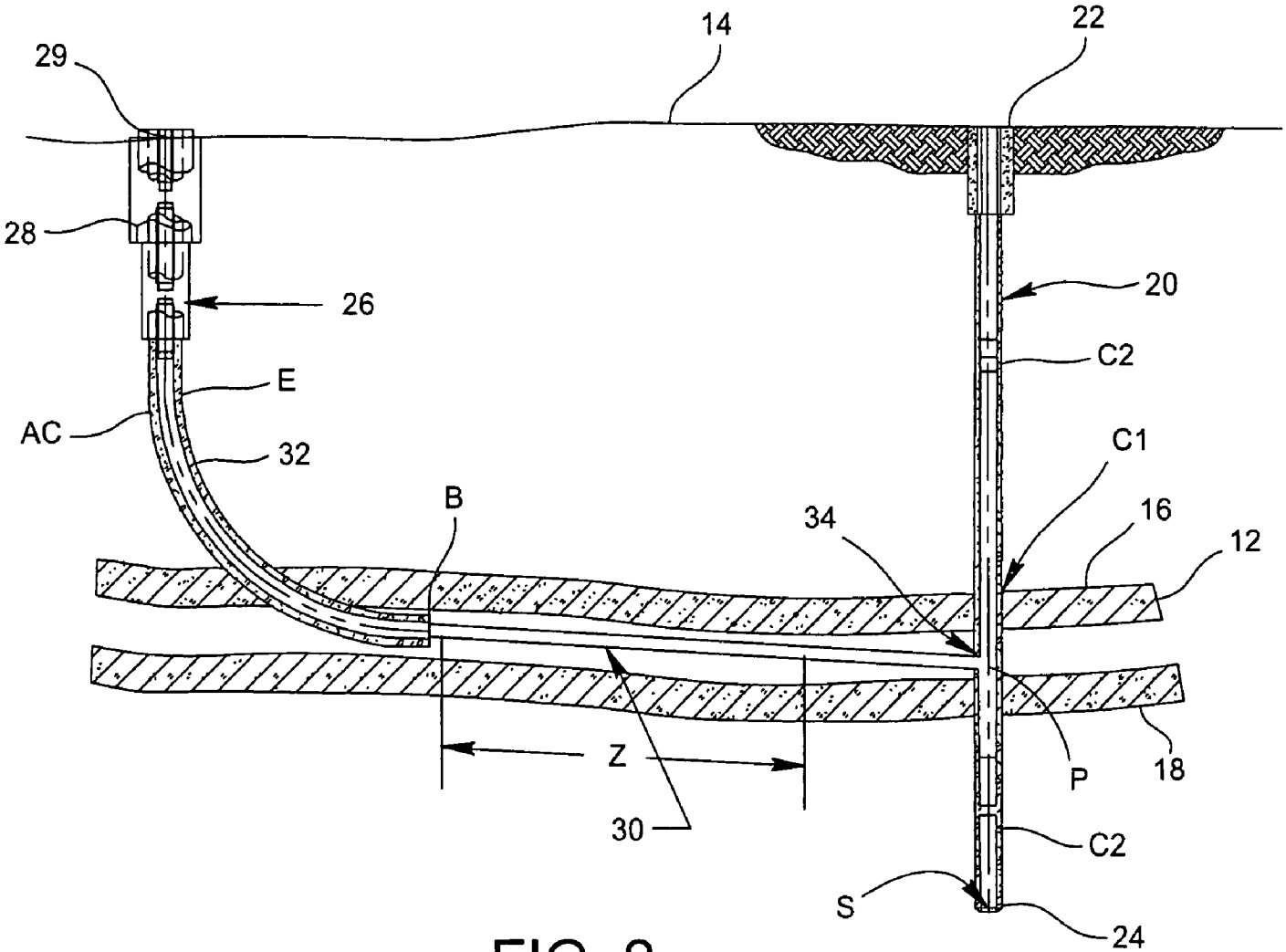
FIG. 2 is a cross-sectional side schematic view showing an access hole intersecting a vertical main well of the arrangement shown in FIG. 1A.

Referring to FIG. 2, the vertical main well 20 is drilled and aligned with a designated cylindrical casing or casings which is well known in the art. For example, a first casing C1, which may be made of a composite material such as fiberglass, is positioned within or "sandwiches" the targeted coal bed 12 approximately thirty-feet above and below the coal bed 12 and through the coal bed 12 so that it can be safely mined in the future after taking the necessary precautions prior to mining. Further, a second casing C2, which may be made of metal such as steel, may be used above and below the first casing C1.

Referring to FIGS. 1A, 1B and 2, the arrangement 10 also includes an access hole 26 that includes a substantially vertical portion 28 coupled to a curved intermediate portion 32, which is coupled to a substantially horizontal or lateral portion 30. The vertical portion 28 having an upper end 29 begins at the surface 14 and is laterally offset from the upper end 22 of the vertical main well 20 and extends to a point, for example, approximately 150 to 1,000 feet above the coal bed 12. The curved portion 32 begins at an end E of the vertical portion 28 and extends through the top 16 of the coal bed 12 and into the coal bed 12. The lateral portion 30 having a lateral end 34 extends into the coal bed 12 just beyond the curved portion 32. Using prior art directional drilling methods, the lateral end 34 of the lateral portion 30 intersects, but does not pass through, the vertical main well 20 at an interception point P near the bottom 18 of the coal bed 12 using Rotating Magnet Ranging technology patented and provided by Vector Magnetics, LLC in conjunction with directional drilling methods. The lateral end 34 of the lateral portion 30 does not extend beyond the vertical main well 20. The lateral end 34 of the lateral portion 30 is drilled using general techniques known to those skilled in the art including under-balanced directional drilling while maintaining the lateral portion's trajectory within the coal bed 12. The access hole 26 is positioned upstream from the intersection point P of the lateral end 34 and the vertical main well 20.

Figure 3:
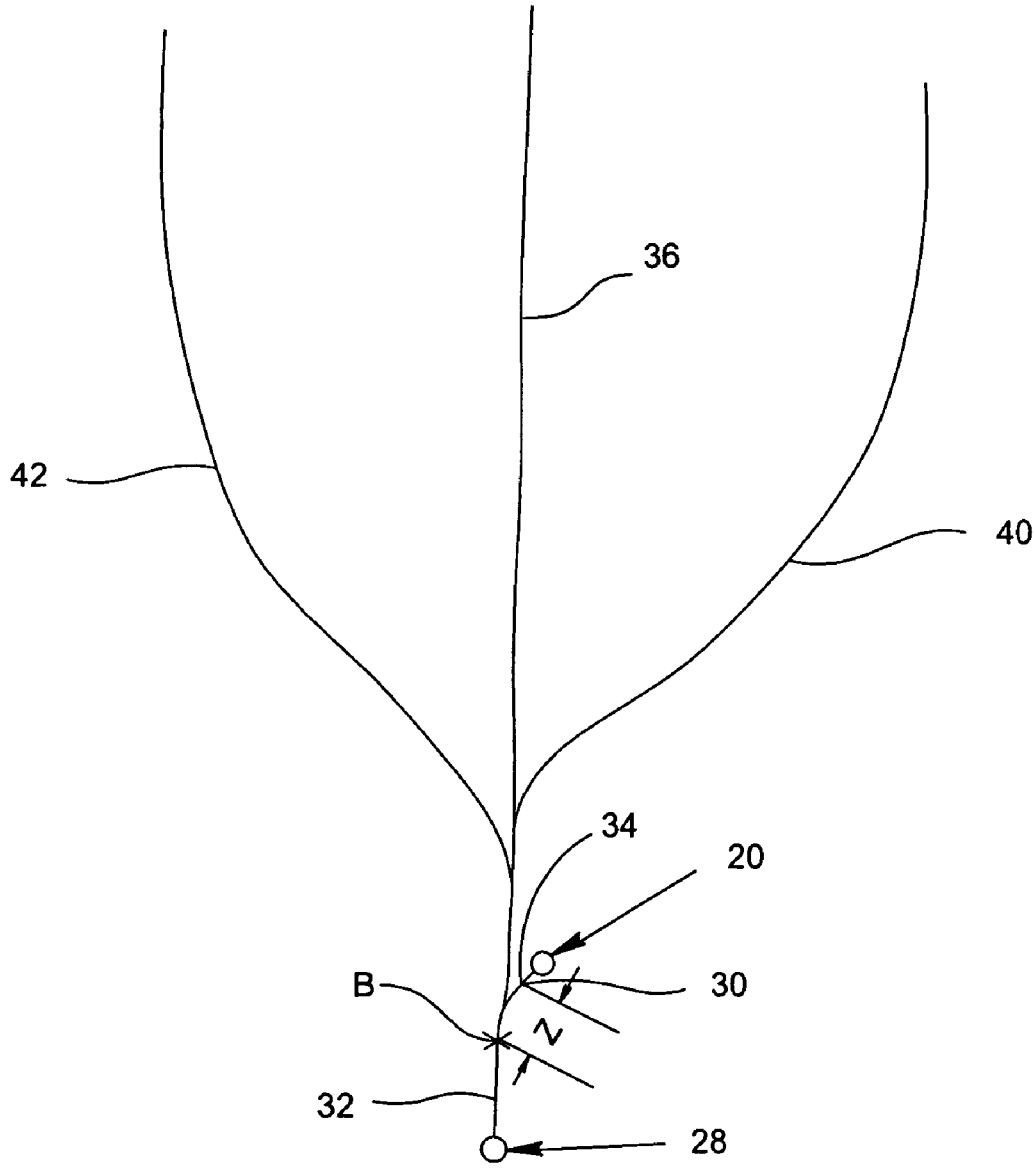
FIG. 3 is a plan view schematic of just a few of the many possible patterns to drill laterally extending holes in relation to a bottom of a curved intermediate portion of the access hole and the vertical main well as shown in FIGS. 1A and 1B.
Figure 4:
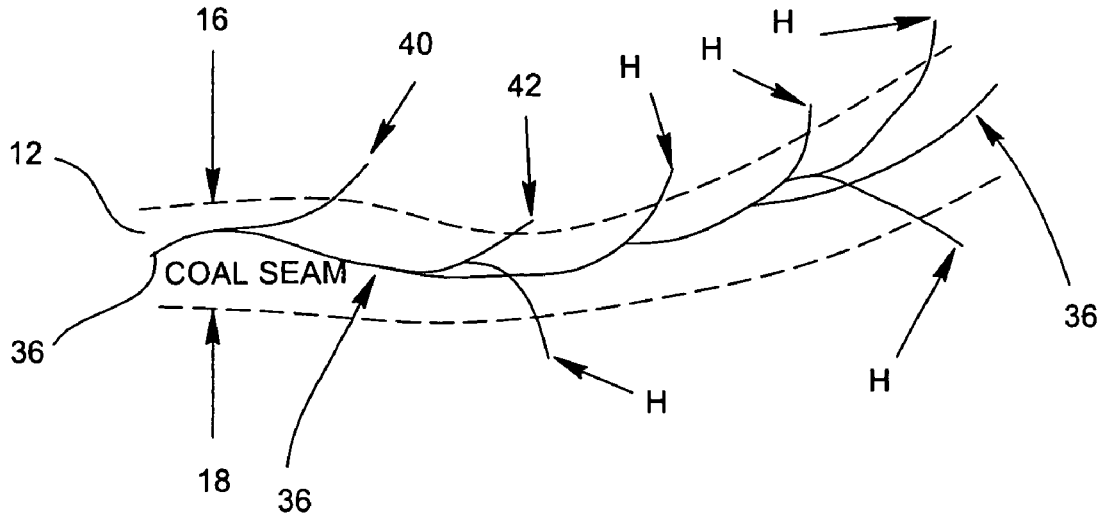
FIG. 4 is a side view of a parent bore of a laterally extending hole having additional branch holes sidetracked therefrom.

Referring to FIG. 1B, a laterally extending hole 36 is drilled starting or initiated from an intercepted zone Z defined on the access hole 26 just beyond a bottom B of the curved portion 32 and slightly upstream of the intersection point P of the lateral end 34 of the lateral portion 30 of the access hole 26. The lateral hole 36 does not intercept the vertical main well 20, but extends to the left or right of the vertical main well 20 a distance into the coal bed 12 in a variety of plan view lateral patterns as shown in FIGS. 3 and 4. For example, the lateral hole 36 can extend and will be maintained within the coal bed 12 for a horizontal length of about 1,000 to greater than 5,000 feet. The lateral hole 36 is preferably drilled "up dip" to allow the desired drainage to flow (via gravity) into the curved portion 32 of the access hole 26, or drilled "down dip" providing gas pressure in the coal bed 12 that exceeds the hydraulic head pressure measured from an end of the down dip lateral hole and the elevation of the intercept with the vertical main well 20 and the intercepted zone Z of the lateral portion 30 just beyond the bottom B of the curved portion 32. Unlike the prior art, if the directional drill bit intercepts the roof or floor rock above or below the coal bed 12, branch or sidetrack holes (40 shown in FIG. 1B and 40, 42 shown in FIG. 3) will be conducted to keep the parent lateral hole 36 entirely in the coal bed as shown in FIG. 4. Sidetracking or branching of the lateral holes eliminates all segments of adjacent rock above or below the coal bed 12 that was drilled, thereby keeping the parent lateral hole 36 within the coal bed 12 to maximize gas recovery.

Referring to FIG. 1A, a plurality of spaced apart lateral holes 36, 38 and 39 can also be initiated from different points on the intercepted zone Z of the lateral portion 30 of the access hole 26 and drilled either to the left or right of the main vertical well 20 into the coal bed 12. It is important that the lateral holes 36, 38 and 39 do not intersect the vertical main well 20. Numerous additional non-intercepting lateral holes can be initiated at different points of the intercepted zone Z of the access hole 26 and extend a distance into the coal bed 12 to provide additional gas recovery. Also, numerous branch holes H (40, 42 shown in FIG. 3) can also be side-tracked from lateral hole 36 or any additional lateral holes in a variety of plan view patterns as shown in FIG. 4.

Referring to FIG. 2, a portion of the access hole 26 can be aligned with a designated casing AC such as cement, wherein the casing AC extends from the vertical portion 28 and the curved portion 32 and ends at a point just upstream of the intercepted zone Z of the access hole 26. The cemented casing AC can start from the end E of the vertical portion 28 to the bottom B of the curved portion 32 of the access hole 26, or all the way back to the surface 14. Also, casing of the curved portion 32 can start, for example, about twenty feet above the kick-off point (KOP) where the curved portion 32 was initiated from the end E of the vertical portion 28 and cemented only in the curved portion 32 to the end E of the vertical portion 28. The casing AC may be made of another material such as metal, wherein the cement is placed in an annulus of an outside wall of the casing AC and an inside wall of the curved portion 32 and the vertical portion 28 of the access hole 26.

In order to create an under-balanced condition during drilling of the lateral holes 36, 38 and 39, or any additional lateral holes, a gas such as compressed air or air foam is injected into the vertical main well 20 and flows in one direction (as shown by arrows A in FIG. 1B) from the vertical main well 20 and into the lateral end 34 of the lateral portion 30 and out of the access hole 26 to the surface 14. The addition of compressed gas to the drilling effluent changes its specific gravity, creating a resultant mixture that is lighter than the drilling effluent or waste material alone. The flow of compressed air through the vertical main well 20 and the lateral portion 30 helps lift the fluid collected in the curved portion 32 up through the vertical portion 28 of the access hole 26 to the surface 14 to prevent over-pressurization in the coal bed 12. In the under-balanced condition, the drilling effluent pressure is kept below the natural formation pressure of the coal bed 12, wherein the lighter mixture of compressed gas, drilling effluent or waste material is forced under pressure up through the access hole 26 and exits at the surface 14. A dewatering pump (not shown) can also be installed in the vertical main well 20 below the intersection point P during drilling of the lateral holes to remove drill effluent without interfering with the directional drilling of the lateral holes while injecting compressed gas or air foam down the vertical main well 20.

Figure 1C:
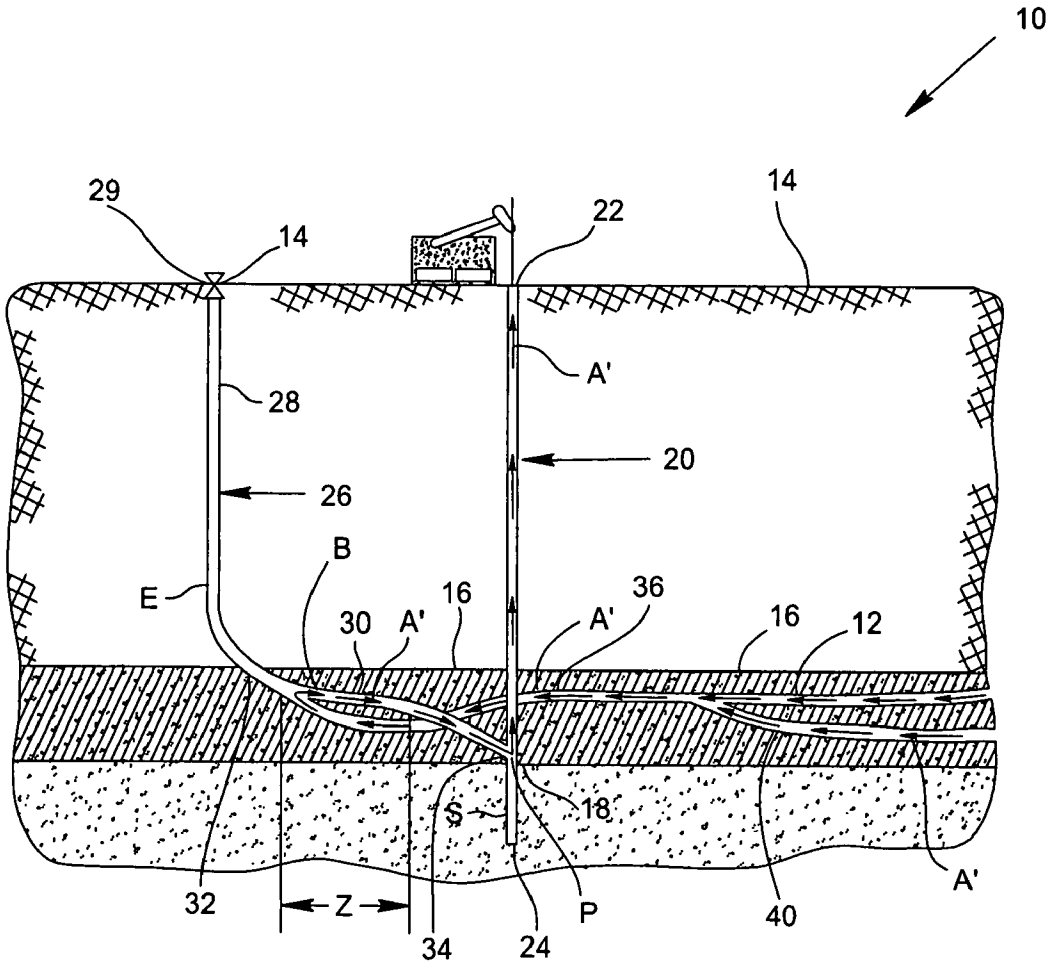
FIG. 1C is a cross-sectional schematic view of the arrangement shown in FIG. 1B showing the flow of gas through the arrangement.

After the drilling process is complete, the pump installed in the main vertical well 20 is used to dewater the lateral holes 36, 38 and 39 and to produce gas coming from the lateral holes 36, 38 and 39 while keeping the pressure in all of the lateral holes 36, 38 and 39 and at the lower end 24 of the vertical main well 20 and bottom of the curved portion 32 below the formation pressure of the coal bed 12, preferably at zero pressure to ensure gas production to the surface 14 through the vertical main well 20 and/or the curved portion 32 and vertical portion 28 of the access hole 26. Referring to FIG. 1C, when the access hole 26 is blocked, gas flows (as represented by arrow A') from the laterally extending hole 36 (and the other laterally extending holes 38 and 39) to the lateral portion 30 of the access hole 26 and the vertical main well 20, and exits from the upper end 22 thereof. Conversely, by not blocking the access hole 26, gas produced from the lateral holes 36, 38 and 39 can flow out of the curved portion 32 and vertical portion 28 of the access hole 26 and through the vertical main well 20, simultaneously. Water then can be pumped out of the vertical main well 20 during and after drilling of lateral holes into the coal bed 12.

Figure 5:
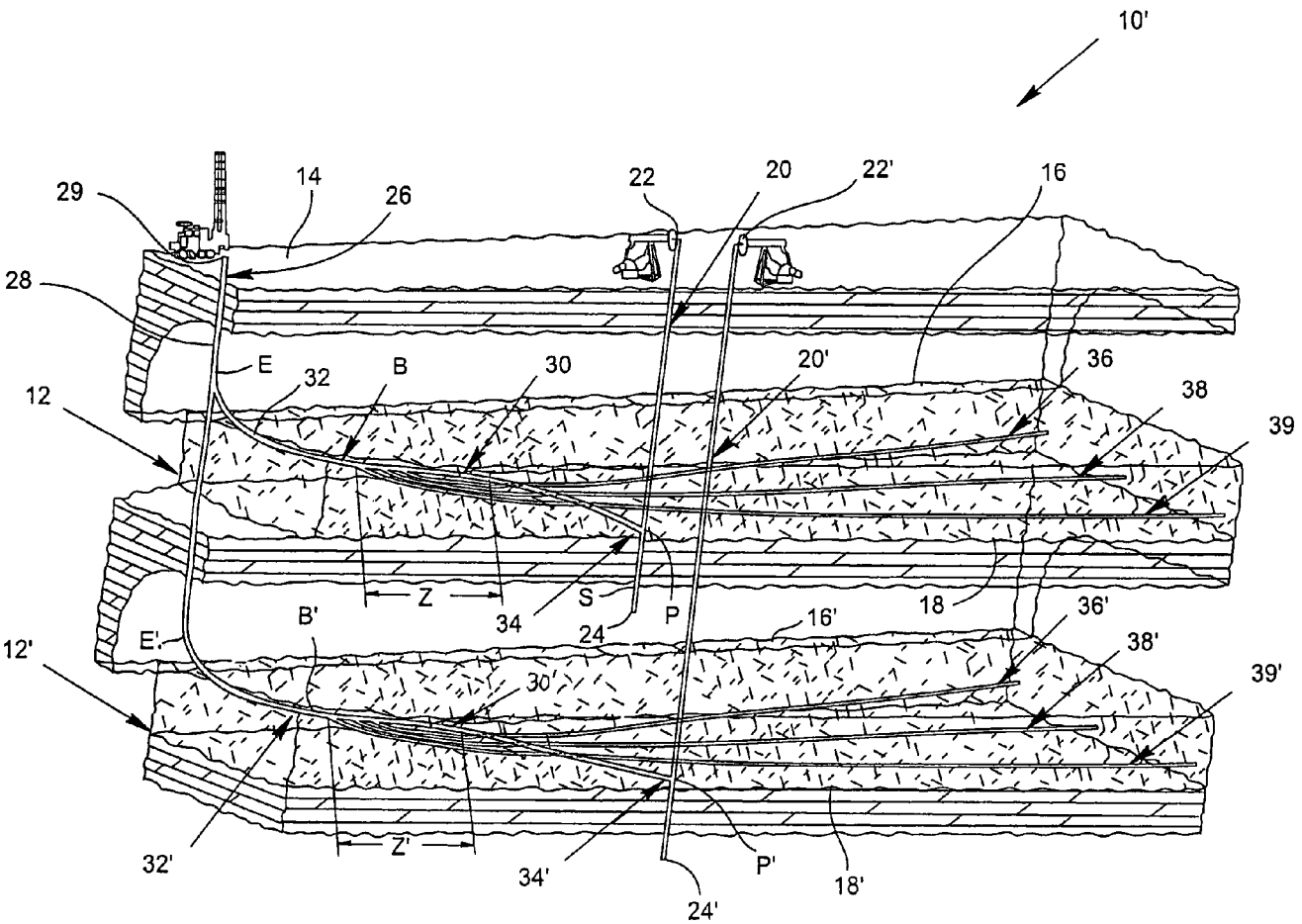
FIG. 5 is an illustration of a production well arrangement provided in a gas producing strata according to a second embodiment of the present invention.

Referring to FIG. 5, the method of arrangement 10 can also be applied to multiple gas bearing formations at different elevations using an arrangement 10' according to a second embodiment of the present invention. Like reference numerals are used for like parts. In the arrangement 10', a second vertically extending main well 20' that is similar to well 20 extends from a surface 14 to a point below a bottom 18' of a second coal bed 12'. The second vertical main well 20' is laterally offset from the first vertical main well 20. Because the coal beds 12, 12' are at different elevations, the second main well 20' extends below the first main well 20.

With continued reference to FIG. 5, the access hole 26 of arrangement 10' further includes a second curved intermediate portion 32' coupled to a second lateral portion 30' extending from the vertical portion 28. The second curved portion 32' and second lateral portion 30' are vertically spaced from the first curved portion 32 and first lateral portion 30. The second lateral portion 30' intersects the second vertical main well 20' at a second intersection point P' positioned between ends 22', 24' of the second vertical main well 20'. A lateral end 34' of the second lateral portion 30' does not extend beyond the second vertical main well 20'. The arrangement 10' further includes one or more second laterally extending holes 36', 38' and 39' that is initiated from a second intercepted zone Z' defined on the second lateral portion 30', which is upstream of the second intersection point P'. The second laterally extending holes 36', 38' and 39' also do not intersect the second vertical main well 20' or the first vertical main well 20.

The method of forming an under balanced condition in arrangement 10' is similar to arrangement 10. When the access hole 26 is blocked, gas flows from the first laterally extending holes 36, 38 and 39 through the first lateral portion 30 and through the first vertical main well 20 to the upper end 22 thereof. Also, gas flows from the second laterally extending holes 36', 38' and 39' through the second lateral portion 30' and through the second vertical main well 20' to the upper end 22' thereof. Further, the same vertical main well or numerous dewater vertical wells can be used in arrangement 10', whereby a first lateral hole is directionally drilled in each formation and terminates after intersecting one, or more than one, vertical main well(s).

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A production well arrangement provided in gas producing strata comprising:

a first vertically extending well into a gas producing strata, said well having a substantially continuous diameter, said well having an upper end defined on a ground surface and a lower end;

a first access hole, said first access hole having a vertical portion coupled to a curved intermediate portion, which is coupled to a lateral portion, said vertical portion having an upper end defined on the ground surface and laterally offset from said upper end of the first vertically extending well, said lateral portion having a lateral end intersecting said first vertically extending well at an intersection point positioned between said first vertically extending well upper end and said first vertically extending well lower end, said lateral end of said lateral portion does not extend beyond the first vertically extending well, said first access hole is positioned upstream from said intersection point of said lateral end and said first vertically extending well; and one or more laterally extending holes extending from an intercepted zone defined on the first access hole, which is upstream of the intersection point, said one or more laterally extending holes do not intersect said first vertically extending well, wherein said first access hole is blocked so that a gas flows from said one or more laterally extending holes to said lateral portion of said first access hole, to said first vertically extending well and exits from the upper end thereof.

2. The production well arrangement as claimed in claim 1, wherein said first vertically extending well includes a cylindrical casing.

3. The production well arrangement as claimed in claim 2, wherein said casing comprises a composite casing.

4. The production well arrangement as claimed in claim 2, wherein a portion of said first access hole has an access hole casing upstream of said intercepted zone.

5. The production well arrangement as claimed in claim 1, wherein said first vertically extending well includes a pump positioned below said intersection point.

6. The production well arrangement as claimed in claim 1, wherein a portion of said first access hole has an access hole casing upstream of said intercepted zone.

7. The production well arrangement as claimed in claim 6, wherein said access hole casing extends from said vertical portion of the access hole and said curved intermediate portion of said access hole.

8. The production well arrangement as claimed in claim 6, wherein said casing comprises cement.

9. The production well arrangement as claimed in claim 1, wherein said vertical production well passes through a coal bed, said lateral portion is positioned within the coal bed and said one or more laterally extending holes are positioned in the coal bed.

10. The production well arrangement as claimed in claim 9, wherein one or more sidetrack holes are formed to keep each of the one or more laterally extending holes entirely within the coal bed when a directional drill bit intercepts rock above or below the coal bed.

11. The production well arrangement as claimed in claim 1, wherein said gas is methane.

12. The production well arrangement as claimed in claim 11, wherein said strata is a coal bed.

13. The production well arrangement as claimed in claim 1, wherein the production well includes a plurality of spaced laterally extending holes, each intersecting different points on the intercepted zone of the access hole.

14. The production well arrangement as claimed in claim 1, further comprising a second vertically extending well laterally spaced from said first vertically extending well:

the second vertically extending well into a gas producing strata, said well having a substantially continuous diameter, said well having an upper end defined on a ground surface and a lower end;

a second access hole, said access hole having a vertical portion coupled to a curved intermediate portion, which is coupled to a lateral portion, said vertical portion having an upper end coupled to the vertical portion of said first access hole, said lateral portion having a lateral end intersecting said second vertically extending well at an intersection point positioned between said second vertically extending well upper end and said second vertically extending well lower end, said lateral end of said lateral portion does not extend beyond the second vertically extending well, said access hole is positioned upstream from said intersection point of said lateral end and said second vertically extending well; and one or more laterally extending holes extending from an intercepted zone defined on the second access hole, which is upstream of the intersection point, said one or more laterally extending holes do not intersect said second vertically extending well.

15. A method of forming an under balanced gas producing well in a ground, comprising the steps of:

a. forming a first vertically extending well into the ground and into a gas producing strata, said well having a substantially continuous diameter, said well having an upper end defined on a ground surface and a lower end;

b. forming an access hole in the ground, the access hole having a vertical portion coupled to a curved intermediate portion, which is coupled to a lateral portion, the vertical portion having an upper end defined on the ground surface and laterally offset from the upper end of the first vertically extending well, the lateral portion having a lateral end intersecting the vertically extending well at an intersection point positioned between the vertical well upper end and the vertical well lower end, the lateral end of the lateral portion does not extend beyond the vertically extending well, the access hole is positioned upstream from the intersection point of the lateral end and the vertically extending well;

c. forming one or more laterally extending holes from an intercepted zone defined on the access hole, which is positioned upstream of the intersection point, the one or more laterally extending holes do not intersect the first vertically extending well; and d. blocking the access hole so that a gas flows from said one or more laterally extending holes to the lateral portion of the access hole, to the first vertically extending well and exits from the upper end thereof.

16. The method as claimed in claim 15, further comprising the step of providing a cylindrical casing in the first vertically extending well.

17. The method as claimed in claim 16, wherein said casing is a composite casing.

18. The method as claimed in claim 16, further comprising the step of providing an access hole casing upstream of the intercepted zone.

19. The method as claimed in claim 15, further comprising the step of pumping water and/or debris from the first vertically extending well to the ground surface.

20. The method as claimed in claim 15, further comprising using drilling fluid and/or air-foam to drill the first vertically extending hole, the access hole and the one or more laterally extending holes.

21. The method as claimed in claim 15, further comprising the step of providing an access hole casing upstream of the intercepted zone.

22. The method as claimed in claim 21, wherein the access hole casing extends from the vertical portion of the access hole and the curved intermediate portion of the access hole.

23. The method as claimed in claim 22, wherein the casing comprises cement.

24. The method as claimed in claim 15, wherein the first vertically extending well passes through a coal bed, the lateral portion of the access hole is positioned within the coal bed and the one or more laterally extending holes are positioned in the coal bed.

25. The method as claimed in claim 24, wherein one or more sidetrack holes are formed to keep each of the one or more laterally extending holes entirely within the coal bed when a directional drill bit intercepts rock above or below the coal bed.

26. The method as claimed in claim 15, wherein the gas comprises methane.

27. The method as claimed in claim 15, wherein the strata is a coal bed.

28. The method as claimed in claim 15, wherein the one or more laterally extending holes comprise a plurality of spaced laterally extending holes each intersecting different points on the intercepted zone of the access hole.

29. The method as claimed in claim 15, further comprising forming a second vertically extending well into the ground and into a second gas producing strata, the second vertically extending well having a substantially continuous diameter and having an upper end defined on the ground surface and a lower end, the second vertically extending well laterally offset from the first vertically extending well;

the access hole having a second curved intermediate portion coupled to a second lateral portion extending from the vertical portion, the second curved intermediate portion and second lateral portion vertically spaced from the first intermediate portion and first lateral portion, the second lateral portion intersecting the second vertically extending well at a second intersection point positioned between ends of the second vertically extending well, a lateral end of the second lateral portion does not extend beyond the second vertically extending well; and forming one or more second laterally extending holes from an intercepted zone defined on the second lateral portion, which is upstream of the second intersection point, the one or more second laterally extending holes do not intersect the second vertically extending well or the first vertically extending well.

30. The method as claimed in claim 29, wherein one of the first vertically extended well and the second vertically extending well extends below the other of the first vertically extending well and the second vertically extending well.

31. The method as claimed in claim 29, further comprising the steps of blocking the access hole so that gas flows from the first laterally extending holes through the first lateral portion and through the first vertically extending well to the upper end thereof and gas flows from the second laterally extending holes through the second lateral portion and through the second vertically extending well to the upper end thereof.

32. The method as claimed in claim 29, further comprising the step of blocking the access hole so that gas flows from the second laterally extending holes through the second lateral portion and through the second vertically extending well to the upper end thereof.

33. A method of forming an under balanced gas producing well in a ground, comprising the steps of:

a. forming a first vertically extending well into the ground and into a gas producing strata, said well having a substantially continuous diameter, said well having an upper end defined on a ground surface and a lower end;

b. forming an access hole in the ground, the access hole having a vertical portion coupled to a curved intermediate portion, which is coupled to a lateral portion, the vertical portion having an upper end defined on the ground surface and laterally offset from the upper end of the first vertically extending well, the lateral portion having a lateral end intersecting the vertically extending well at an intersection point positioned between the vertical well upper end and the vertical well lower end, the lateral end of the lateral portion does not extend beyond the vertically extending well, the access hole is positioned upstream from the intersection point of the lateral end and the vertically extending well;

c. forming one or more laterally extending holes from an intercepted zone defined on the access hole, which is positioned upstream of the intersection point, the one or more laterally extending holes do not intersect the first vertically extending well;

d. forming a second vertically extending well into the ground and into a second gas producing strata, the second vertically extending well having a substantially continuous diameter and having an upper end defined on the ground surface and a lower end, the second vertically extending well laterally offset from the first vertically extending well;

the access hole having a second curved intermediate portion coupled to a second lateral portion extending from the vertical portion, the second curved intermediate portion and second lateral portion vertically spaced from the first interned iate portion and first lateral portion, the second lateral portion intersecting the second vertically extending well at a second intersection point positioned between ends of the second vertically extending well, a lateral end of the second lateral portion does not extend beyond the second vertically extending well; and e. forming one or more second laterally extending holes from an intercepted zone defined on the second lateral portion, which is upstream of the second intersection point, the one or more second laterally extending holes do not intersect the second vertically extending well or the first vertically extending well, wherein one of the first vertically extending well and the second vertically extending well extends below the other of the first vertically extending well and the second vertically extending well.

34. A method of forming an under balanced gas producing well in a ground, comprising the steps of:

a. forming a first vertically extending well into the ground and into a gas producing strata, said well having a substantially continuous diameter, said well having an upper end defined on a ground surface and a lower end;

b. forming an access hole in the ground, the access hole having a vertical portion coupled to a curved intermediate portion, which is coupled to a lateral portion, the vertical portion having an upper end defined on the ground surface and laterally offset from the upper end of the first vertically extending well, the lateral portion having a lateral end intersecting the vertically extending well at an intersection point positioned between the vertical well upper end and the vertical well lower end, the lateral end of the lateral portion does not extend beyond the vertically extending well, the access hole is positioned upstream from the intersection point of the lateral end and the vertically extending well;

c. forming one or more laterally extending holes from an intercepted zone defined on the access hole, which is positioned upstream of the intersection point, the one or more laterally extending holes do not intersect the first vertically extending well;

d. forming a second vertically extending well into the ground and into a second gas producing strata, the second vertically extending well having a substantially continuous diameter and having an upper end defined on the ground surface and a lower end, the second vertically extending well laterally offset from the first vertically extending well;

the access hole having a second curved intermediate portion coupled to a second lateral portion extending from the vertical portion, the second curved intermediate portion and second lateral portion vertically spaced from the first intermediate portion and first lateral portion, the second lateral portion intersecting the second vertically extending well at a second intersection point positioned between ends of the second vertically extending well, a lateral end of the second lateral portion does not extend beyond the second vertically extending well;

e. forming one or more second laterally extending holes from an intercepted zone defined on the second lateral portion, which is upstream of the second intersection point, the one or more second laterally extending holes do not intersect the second vertically extending well or the first vertically extending well; and f. blocking the access hole so that gas flows from the first laterally extending holes through the first lateral portion and through the first vertically extending well to the upper end thereof and gas flows from the second laterally extending holes through the second lateral portion and through the second vertically extending well to the upper end thereof.

35. A method of forming an under balanced gas producing well in a ground, comprising the steps of:

a. forming a first vertically extending well into the ground and into a gas producing strata, said well having a substantially continuous diameter, said well having an upper end defined on a ground surface and a lower end;

b. forming an access hole in the ground, the access hole having a vertical portion coupled to a curved intermediate portion, which is coupled to a lateral portion, the vertical portion having an upper end defined on the ground surface and laterally offset from the upper end of the first vertically extending well, the lateral portion having a lateral end intersecting the vertically extending well at an intersection point positioned between the vertical well upper end and the vertical well lower end, the lateral end of the lateral portion does not extend beyond the vertically extending well, the access hole is positioned upstream from the intersection point of the lateral end and the vertically extending well;

c. forming one or more laterally extending holes from an intercepted zone defined on the access hole, which is positioned upstream of the intersection point, the one or more laterally extending holes do not intersect the first vertically extending well;

d. forming a second vertically extending well into the ground and into a second gas producing strata, the second vertically extending well having a substantially continuous diameter and having an upper end defined on the ground surface and a lower end, the second vertically extending well laterally offset from the first vertically extending well;

the access hole having a second curved intermediate portion coupled to a second lateral portion extending from the vertical portion, the second curved intermediate portion and second lateral portion vertically spaced from the first intermediate portion and first lateral portion, the second lateral portion intersecting the second vertically extending well at a second intersection point positioned between ends of the second vertically extending well, a lateral end of the second lateral portion does not extend beyond the second vertically extending well;

e. forming one or more second laterally extending holes from an intercepted zone defined on the second lateral portion, which is upstream of the second intersection point, the one or more second laterally extending holes do not intersect the second vertically extending well or the first vertically extending well; and f. blocking the access hole so that gas flows from the second laterally extending holes through the second lateral portion and through the second vertically extending well to the upper end thereof.

* * * * *

UNITED STATES PATENT AND TRADEMARK OFFICE

CERTIFICATE OF CORRECTION

PATENT NO. : 7,493,951 B1
APPLICATION NO. : 11/598555
DATED : February 24, 2009
INVENTOR(S) : Kravits et al.

It is certified that error appears in the above-identified patent and that said Letters Patent is hereby corrected as shown below:

Column 10, Line 52, Claim 33, "interned iate" should read -- intermediate --

Signed and Sealed this

Nineteenth Day of May, 2009

JOHN DOLL
*Acting Director of the United States Patent and Trademark Office*